United States Patent [19]

Allen

[11] 4,048,078

[45] Sept. 13, 1977

[54] OIL RECOVERY PROCESS UTILIZING AIR AND SUPERHEATED STEAM

[75] Inventor: Joseph C. Allen, Bellaire, Tex.

[73] Assignee: Texaco Inc., New York, N.Y.

[21] Appl. No.: 595,652

[22] Filed: July 14, 1975

[51] Int. Cl.[2] ..... E21B 43/22

[52] U.S. Cl. ..... 252/8.55 D; 166/261; 166/272

[58] Field of Search ..... 252/8.55 D, 8.55 R; 166/261, 272

[56] References Cited

U.S. PATENT DOCUMENTS

| | | | |
|---|---|---|---|
| 2,839,141 | 6/1958 | Walter | 166/261 |
| 3,115,929 | 12/1963 | Emery | 166/261 |
| 3,150,715 | 9/1964 | Dietz | 166/261 |
| 3,208,519 | 9/1965 | Moore | 166/261 |
| 3,221,813 | 12/1965 | Closmann et al. | 166/272 X |
| 3,279,538 | 10/1966 | Doscher | 166/272 X |
| 3,515,212 | 6/1970 | Allen et al. | 166/261 X |
| 3,731,741 | 5/1973 | Palmer et al. | 166/272 |

*Primary Examiner*—Herbert B. Guynn

*Attorney, Agent, or Firm*—Thomas H. Whaley; Carl G. Ries; Walter D. Hunter

[57] ABSTRACT

Petroleum may be recovered from viscous petroleum containing formations including tar sand deposits by first creating a fluid communication path in the formation, followed by injecting via an injection well a fluid comprising superheated steam and air into the formation via the fluid communication path whereby in situ combustion occurs providing heat and pressure for driving the petroleum in the formation toward the production well. Recovery of the displaced petroleum is accomplished via the production well.

4 Claims, 1 Drawing Figure

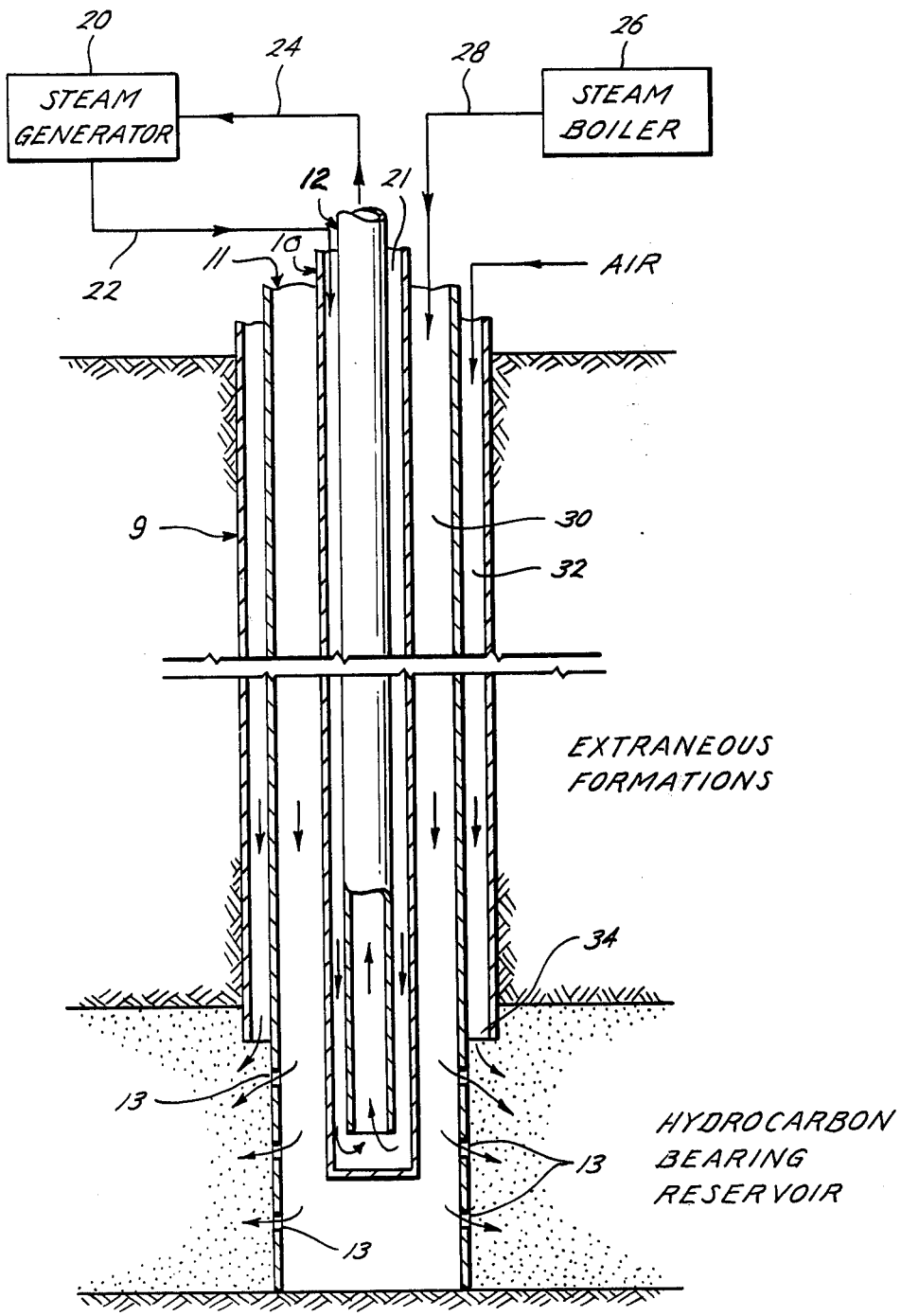
20
STEAM GENERATOR
24
28
26
STEAM BOILER
12
21
10
11
22
AIR
9
30
32
EXTRANEOUS FORMATIONS
34
13
13
13
HYDROCARBON BEARING RESERVOIR

OIL RECOVERY PROCESS UTILIZING AIR AND SUPERHEATED STEAM

BACKGROUND OF THE INVENTION

1. Field of the Invention

This invention pertains to an oil recovery method, and more specifically to a method for recovering oil or petroleum from a subterranean viscous petroleum containing formation such as a tar sand deposit in which a fluid comprising superheated steam and air is introduced into the formation to displace the oil.

2. Description of the Prior Art

There are known to exist throughout the world many subterranean petroleum containing formations from which the petroleum cannot be recovered by conventional means because of the relatively high viscosity thereof. The best known of such viscous petroleum containing formations are the so-called tar sands or bituminous sand deposits. The largest and most famous such deposit is in the Athabasca area in the northeastern part of the Province of Alberta, Canada which is known to contain over 700 billion barrels of petroleum. Other extensive deposits are known to exist in western part of the United States, and Venezuela, and lesser deposits in Europe and Asia.

Tar sands are frequently defined as sand saturated with a highly viscous crude petroleum material not recoverable in its natural state through a well by ordinary production methods. The hydrocarbon contained in tar sand deposits are generally highly bituminous in character. The tar sand deposits are generally arranged as follows. Fine quartz sand is coated with a layer of water and the bituminous material occupies most of the void space around the wetted sand grains. The balance of the void volume may filled with connate water, and occasionally a small volume of gas which is usually air or methane. The sand grains are packed to a void volume of about 35%, which corresponds to about 83% by weight sand. The balance of the material is bitumen and water. The sum of bitumen and water will almost always equal about 17% by weight, with the bitumen portion varying from about 2% to around 16%.

It is an unusual characteristic of tar sand deposits that the sand grains are not in any sense consolidated, that is to say the sand is essentially suspended in the solid or nearly solid hydrocarbon material. The API gravity of the bitumen usually ranges from about 6 to about 8, and the specific gravity at 60° F. is from about 1.006 to about 1.027. Approximately 50% of the bitumen is distillable without cracking, and the sulfur content averages between 4 and 5% by weight. The bitumen is also very viscous, and so even if it is recoverable by an in situ separation technique, some on-site refining of the produced petroleum must be undertaken in order to convert it to a pumpable fluid.

Bitumen may be recovered from tar sand deposits by mining or by in situ processes. Most of the recovery to date has been by means of mining, although this is limited to instances where the ratio of the overburden thickness to tar sand deposit thickness is economically suitable, generally defined as one or less. In situ processes have been proposed which may be categorized as thermal, such as fire flooding or steam injection, and steam plus emulsification drive processes. Generation of thermal heat necessary to mobilize the bitumen by means of a subterranean atomic explosion has been seriously considered, although has not yet been attempted.

Despite the many proposed methods for recovering bitumen from tar sand deposits, there still has been no successful exploitation of such deposits by in situ processing on a commercial scale up to the present time. Accordingly, there is a definite need in the art for a satisfactory in situ combustion process, and especially in view of the enormous reserves present in this form which are needed to help satisfy present energy needs, there is a substantial need for a workable method for recovery of bitumen from tar sand deposits.

SUMMARY OF THE INVENTION

In its broadcast aspect this invention relates to a method for recovering petroleum from subterranean, viscous petroleum containing formations including tar sand deposits, said formations being penetrated by at least one injection well and by at least one production well, comprising:

a. establishing a fluid communication path in the formation between the injection well and the production well;

b. injecting via an injection well a fluid comprising superheated steam and air under pressure into the formation whereby in situ combustion is initiated in the formation providing heat and pressure for driving the petroleum in the formation toward the production well, and c. recovering petroleum from the formation via the production well.

BRIEF DESCRIPTION OF THE DRAWING

The FIGURE depicts an injection well through which the superheated steam-air mixture is injected into the formation which is equipped to serve as a superheater.

DETAILED DESCRIPTION OF THE INVENTION

In the first step of this process a communication path is established in the formation. The ideal communication path is an essentially horizontal, pancake shaped zone of high permeability preferably at or near the bottom of the tar sand or petroleum reservoir.

It is sometimes discovered that there is a water saturated zone in the very bottom of the petroleum reservoir, and this may be utilized successfully to establish the fluid communication path in accordance with our process. The water-saturated zone may be opened up by injecting into the zone a heated fluid such as steam, which will channel preferentially through this water saturated zone to the production well. Asphaltic or other solid or semi-solid hydrocarbon materials present in the water saturated zone will be melted and rendered mobile, and the permeability will be opened up considerably thereby.

Generally, it will be necessary to open up the communication path through the formation by some other means such as hydraulic fracturing. Hydraulic fracturing is a well known technique for establishing a communication path between an injection well and a production well. Fracturing is usually accomplished by forcing a liquid such as water, oil or any other suitable hydrocarbon fraction into the formation at pressures of from about 300 to about 1,500 psig which are sufficient to rupture the formation and to open up channels therein. By use of this method it is possible to position the fracture at any desired vertical location with respect to the bottom of the oil filled zone. It is not essential that the fracture planes be horizontally oriented, although it is of course preferable that they be.

In any event, a communication path of some sort is created, generally confined to the lower portion of the petroleum reservoir. After the fracture has been established, and without diminishing the fracture pressure, a propping agent may be injected into the fracture in order to prevent healing of the fracture which would destroy its usefulness for fluid flow communication purposes. Gravel and sand or mixtures thereof are employed as propping agents, and it is desirable in the instance of tar sand deposits that a wide variation of particle sizes be employed to avoid flowing of the tar sand materials back into the propped fracture zone.

In the next step of the process of this invention a fluid comprising about 20 to about 80 percent by weight of superheated steam and from about 80 to about 20 percent by weight of air at temperatures ranging from about 200° to about 1800° F and pressures ranging from 50 to about 2000 psig is injected into the communication path previously formed in the formation.

In preparing the superheated steam and air mixtures generally steam at a pressure of about 300 to about 1000 psig. is generated in conventional boilers at temperatures preferably above 800° F.

An alternate procedure for injecting the superheated steam-air mixture is to equip the well to serve as a superheater.

By this method air and superheated steam are injected via an ejection well into a subterranean hydrocarbon-bearing formation with a minimum of heat loss to extraneous earth formations by a method which comprises:

a. placing three tubular means inside the well casing so as to provide an annular space between each tubular means and the casing, wherein the said three tubular means comprise an open-end innermost tubular means in communication with a closed end intermediate tubular means and an outer tubular means extending into the formation and being perforated so that there is communication with the hydrocarbon reservoir and wherein said casing extends into the hydrocarbon reservoir, b. injecting steam into the annular space between the open end innermost tubular means and the closed end intermediate tubular means and withdrawing condensate via the open-end innermost tubular means whereby the intermediate tubular means is heated, c. injecting steam having a temperature below that of the steam injected in step (b) into the annular space between the outer tubular means and the intermediate tubular means whereby the steam injected in (c) is superheated and forcing the superheated steam into the hydrocarbon-bearing formation via the perforations in the outer tubular means, and d. injecting air into the annular space between the casing and the outer tubular means and forcing the said air into the hydrocarbon formation.

Such an injection well is shown in the FIGURE. In this arrangement three strings of concentrically located tubing, that is 10, 11, and 12, are employed inside of casing 9. Closed-end tubing string 10 penetrates the well to a depth above perforations 13. A smaller open-ended tubing string 12 penetrates the closed end tubing 10 to a depth just above that of the closure in tubing string 10. Tubing string 11 which as a larger diameter than string 10 penetrates the oil-bearing formation and is equipped with perforations 13 which are positioned so that they open into the oil-bearing zone. Well casing 9 is seated at a point just below the top of the oil-bearing formation and is open at the lower end.

Steam of about 80 percent quality is formed in generator 20 and passed via line 22 into the annular space 21 between tubing strings 10 and 12. As the steam passes down this annular space the walls are heated and the steam which condenses collects at the bottom of closed-end tubing 10 after which the condensate is returned to steam generator 20 via tubing 12 and line 24. Steam from steam boiler 26 having a temperature below that of the steam-flowing in line 22 is injected via line 28 into annular space 30 where it is superheated as it passes downwardly through annular space 30. This superheated steam is then forced into the oil-bearing formation via perforations 30 of tubing strings. Air is injected into annular space between casing 9 and tubing 11 and enters the oil-bearing formation at 34. Thus, in the above-described well arrangement the injection well serves as a superheater.

If desired, the fluid, that is the oil-displacing fluid, injected into the formation may comprise an alkaline fluid or an alkaline fluid containing a minor amount of a solubilizing agent. Useful solubilizing agents include water-soluble, oxyalkylated, nitrogen-containing aromatic compounds having the formula:

$$R(OR')_nOH,$$

wherein R is selected from the group consisting of:

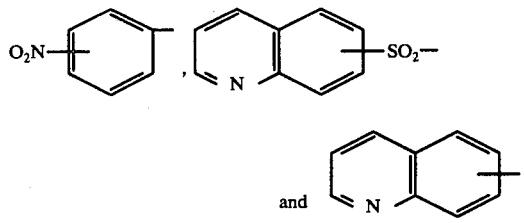

wherein R′ is alkylene of from 2 to 4 inclusive carbon atoms and *n* is an integer of from about 5 to about 50 and preferably from about 5 to about 20. These novel water-soluble oxyalkylated products can be conveniently prepared by a number of processes well known in the art and their preparation is more completely described in U.S. Pat. No. 3,731,741 which is incorporated herein by reference in its entirety.

Another group of solubilizing agents which are highly useful in the process of this invention include compounds of the formula:

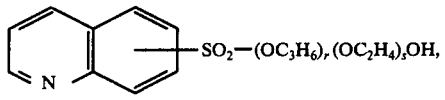

wherein *r* is an integer of from about 3 to about 10, *s* is an integer of from about 5 to about 50 and wherein the sum of *r* plus *s* is not more than 55.

Solubilizing agents of this type can be formed in the same manner as described in U.S. Pat. No. 3,731,741 employing as starting aromatic compounds 8-quinolinesulfonic chloride, 6-quinolinesulfonyl bromide, etc., as initiators and reacting the initiator first with the necessary amount of propylene glycol of the required molecular weight followed by the necessary amount of ethylene glycol of the required molecular weight. The quinoline starting, material may also be substituted by other innocous groups such as alkoxy of from 1 to 4 carbon atoms, alkyl, etc.

EXAMPLE I

This invention is best understood by a reference to the following examples which are offered only as illustrative embodiments of this invention, and are not intended to be limitative or restricted thereof.

A tar sand deposit is located at a depth of 875 feet and it is determined that the thickness of the formation is 120 feet. It is also determined that the petroleum is in the form of a highly bituminous hydrocarbon, and its viscosity at the formation temperature is much too high to permit recovery thereof by conventional means. An injection well is drilled to the bottom of the formation, and perforations are formed between the interval of 850–875 feet, i.e., the bottom of the petroleum saturated zone. A production well is drilled approximately 600 feet distance from the injection well, and perforations are similarly made slightly above the bottom of the petroleum saturated zone. The production well is also equipped with a steam trap so that only liquids can be produced from the formation, and vapors are excluded therefrom.

A fluid communication path low in the formation is formulated by fracturing the formation using conventional hydraulic fracturing techniques, and injecting a gravel-sand mixture into the fracture to hold it open and prevent healing of the fracture.

In the next step a fluid comprising a mixture of about 50 weight percent steam and about 50 weight percent air at a temperature of about 1000° F and at a pressure of about 300 psig. is introduced into the formation at the rate of 5000 lbs/hour. via the previously prepared fluid communication path. Injection of the steam-air mixture is continued and the production of viscous oil via the production well commences after about 30 days and gradually increases an injection of the oil-displacing fluid is continued. At the end of 60 days production of the viscous hydrocarbons is significantly increased over production of similar wells in the same formation utilizing only steam injection.

EXAMPLE II

In this example viscous oil is recovered from a tar sand at a depth of 700 feet and having a thickness of about 28 feet. An injection well is drilled to the bottom of the hydrocarbon bearing structure and the casing perforated in the interval 705 to 715 feet. In a like manner a production well drilled at a distance of about 465 feet from the injection well is perforated at a depth of 700–710 feet, i.e., near the center of the tar sand formation at that location.

In the next step a fluid communication path is formed by fracturing the formation in both wells using conventional hydraulic fracturing technique. A gravel-sand mixture is injected into the formation to hold it open and to prevent healing of the fracture. A mixture fluid comprising a mixture of about 40 percent by weight of steam and about 60 percent by weight of air at a temperature of about 1200° F and at a pressure of about 1000 psig together with 0.001 weight percent of sodium hydroxide and 0.002 weight percent of a solubilizing agent of the formula:

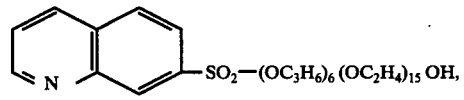

is injected into the fluid communication path via the injection well at a rate of 600 lbs/hour. Injection of this fluid is continued and after about 20 days production of viscous oil is commenced via the production well. Production increases gradually as injection of the fluid is continued. At the end of 60 days the level of production reached is substantially in excess of that obtained with similar wells in the same formation utilizing only steam injection.

What is claimed is:

1. A fluid which comprises about 20 to about 80 weight percent steam and about 80 to about 20 weight percent of air together with about 0.001 to about 0.02 weight percent of a solubilizing agent having the structural formula:

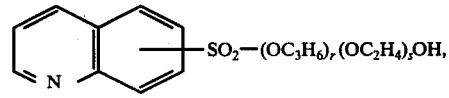

wherein $r$ is an integer of from 3 to 10, $s$ is an integer of from 5 to about 50 and wherein the sum of $r$ plus $s$ is not more than 55 and from about 0.001 to about 0.05 weight percent of an alkaline agent.

2. The fluid of claim 1 wherein the alkaline agent is selected from the group consisting of sodium hydroxide and sodium hypochlorite.

3. The fluid of claim 2 wherein the said alkaline agent is sodium hypochlorite.

4. The fluid of claim 2 wherein the said steam is superheated steam.

* * * * *